US005867960A

United States Patent [19]

Andräet al.

[11] Patent Number: 5,867,960

[45] Date of Patent: Feb. 9, 1999

[54] DOWEL MEMBER FOR REINFORCING CONCRETE STRUCTURES

[76] Inventors: Hans-Peter Andrä, Im Betzengaiern 4, D-70597 Struttgart; Karl H. Jung, deceased, late of Hanau; by Angelika Jung, administratrix, Corniceliusstrasse 4A, D-63450 Hanau; Peter Ernst, Lindenstrasse 7, D-65795 Hattersheim, all of Germany

[21] Appl. No.: 727,644

[22] PCT Filed: Mar. 10, 1995

[86] PCT No.: PCT/EP95/00891

§ 371 Date: Feb. 5, 1997

§ 102(e) Date: Feb. 5, 1997

[87] PCT Pub. No.: WO95/28534

PCT Pub. Date: Oct. 26, 1995

[30] Foreign Application Priority Data

Apr. 13, 1994 [DE] Germany ..... 44 12 598.4

[51] Int. Cl.[6] ..... E04C 5/03; E04C 5/16; E04B 5/43

[52] U.S. Cl. ..... 52/649.1; 52/740.3; 52/740.6; 52/740.7; 52/649.2; 52/724.1

[58] Field of Search ..... 52/223.8, 223.13, 52/649.1, 649.2, 649.6, 649.7, 649.8, 740.1, 740.2, 740.3, 740.4, 740.5, 740.6, 740.7, 724.1

[56] References Cited

U.S. PATENT DOCUMENTS

| | | | |
|---|---|---|---|
| 4,233,364 | 11/1980 | van Thiel . | |
| 4,406,103 | 9/1983 | Ghali et al. | 52/740.7 X |
| 5,038,545 | 8/1991 | Hiendl | 52/740.3 |
| 5,655,349 | 8/1997 | Ghali et al. | 52/724.1 |

FOREIGN PATENT DOCUMENTS

| | | | |
|---|---|---|---|
| 0 318 712 | 6/1989 | European Pat. Off. . | |
| 0 495 334 | 7/1992 | European Pat. Off. . | |
| 173 118 | 10/1903 | Germany . | |
| 1 077 845 | 3/1960 | Germany . | |
| 1171944 | 6/1964 | Germany | 52/740.1 |
| 27 27 159 | 12/1978 | Germany . | |
| 3003025 | 7/1981 | Germany | 52/740.5 |
| 41 29 903 | 3/1991 | Germany . | |
| 209 591 | 4/1940 | Switzerland . | |
| 646 708 | 11/1950 | United Kingdom . | |
| 2075080 | 11/1981 | United Kingdom | 52/740.1 |

*Primary Examiner*—Carl D. Friedman
*Assistant Examiner*—Laura A. Callo
*Attorney, Agent, or Firm*—Burns, Doane, Swecker & Mathis, L.L.P.

[57] ABSTRACT

A dowel member for reinforcing concrete structures includes a metal strip and a plurality of dowels projecting perpendicularly from the strip. Each dowel includes a dowel shank welded at one of its ends to the strip, and a dowel head disposed at the other of its ends. The dowel shank includes a center section having ribs on its outer periphery, and a pair of end sections having smooth cylindrical outer peripheries.

7 Claims, 3 Drawing Sheets

FIG. 1
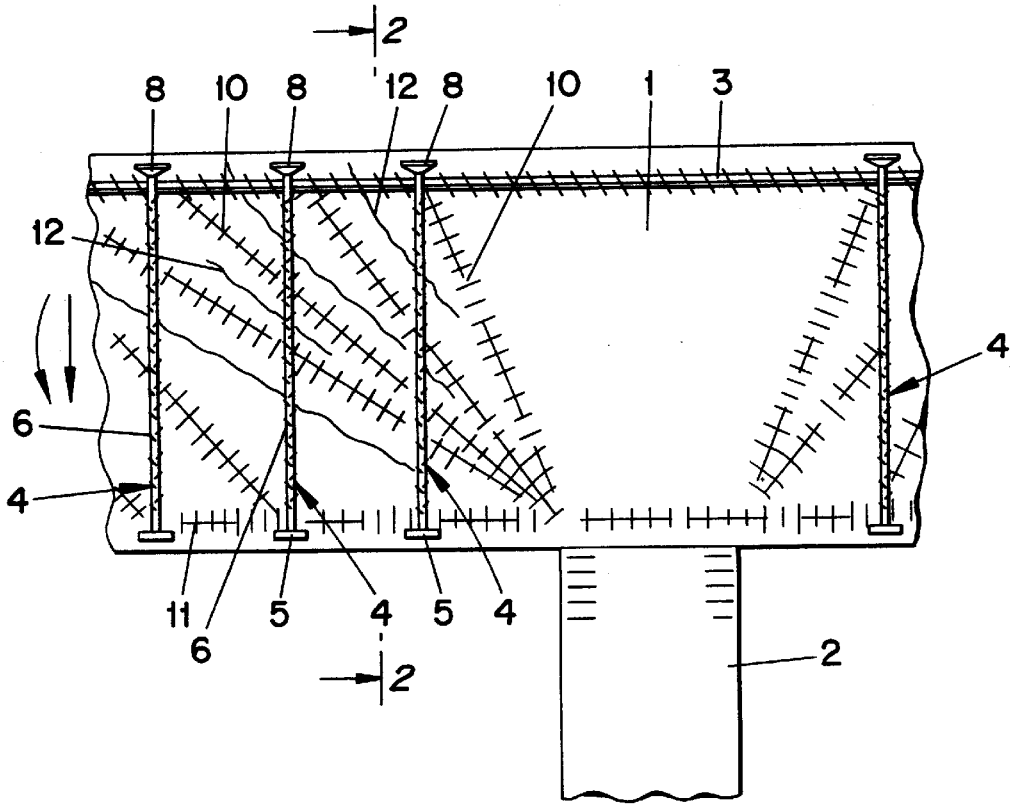
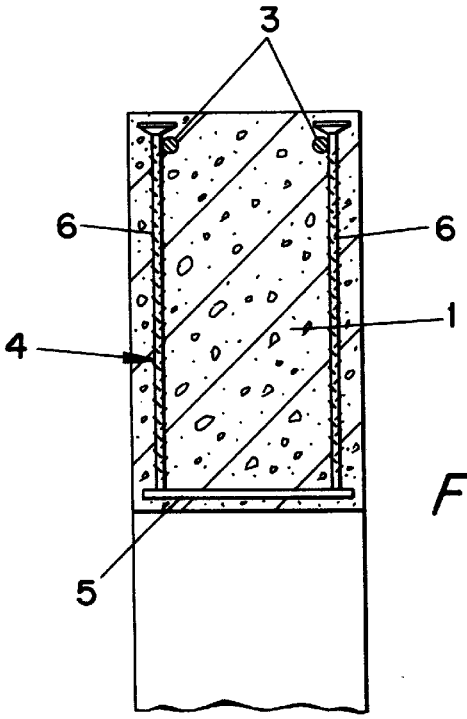
FIG. 2

FIG. 4
(PRIOR ART)
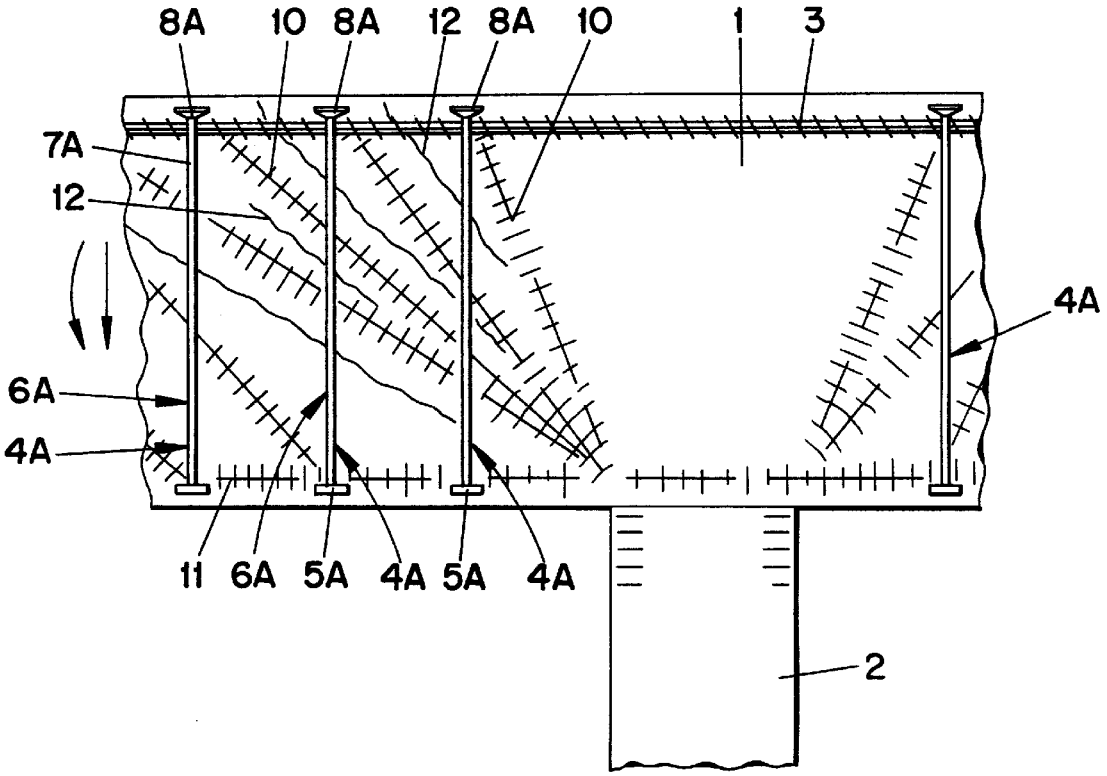
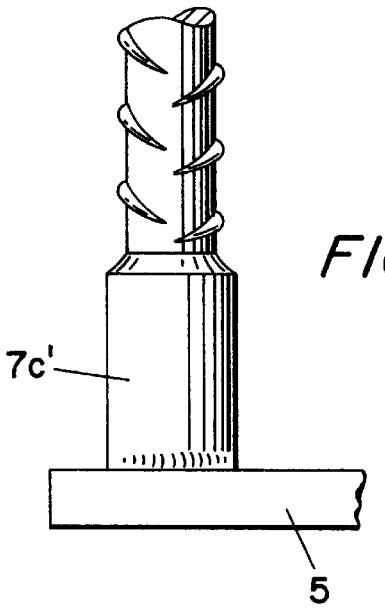
FIG. 5

DOWEL MEMBER FOR REINFORCING CONCRETE STRUCTURES

BACKGROUND OF THE INVENTION

The invention pertains to the reinforcement of concrete beams or panels and, in particular to a dowel strip acting as a bent-up bar in reinforced concrete beams or panels, the dowel strip 4A (see FIG. 4) consisting of a bottom strip and a plurality of dowels 6A perpendicularly welded to the strip at one of their ends 5A, each dowel having a dowel shank 7A and, on their upper ends, a dowel head 8A that is wider than the dowel shank, whereby the dowel shank has ribs on at least part of its surface.

Known dowel strips of this kind (DE-PS 27 27 159.6) serve as bent-up bars in reinforced concrete beams and panels at points of support, particularly in the vicinity of column connections of the beam 1 with vertical columns 2, i.e. connections to absorb the lateral forces occurring in these areas due to stress created by the vertical columns.

In a reinforced concrete beam or concrete panel reinforced in this fashion, an internal compression force grid is formed in the column area, the pattern of which resembles a truss, the truss components of which are referred to with the terms customarily used for trusses.

Longitudinal reinforcement bars 3 provided near the topside of the beam or panel each act as form a tension chord component of the force truss in the area of the columns. The dowels 6A of the dowel strip located perpendicular to these tension chord components represent the vertical tension components of the force truss. The concrete that is in compression on the underside of the beam or the panel in the vicinity of the columns, assumes the function of the compression chord component 11 of the force truss, but this function may also be assumed by the dowel strips if the strips extend in the longitudinal direction of the beams. Between (i) the dowel heads on top and the points of support of the column or the dowel strips of adjacent additional dowels, sloped strut component 10 of the force truss are formed in the concrete.

The formation of a joint of the force truss at the dowel head or strip, respectively, requires that the vertical tension component 6A be transferred all the way to the dowel head or strip, respectively, so that the differential forces can be transferred to the tension chord component 3 or the compression chord component 11, respectively through a positive enclosure by the concrete.

In the known dowel strips, the dowel shank 7A is designed smooth and cylindrical as shown in FIG. 4; the resulting relatively minor adhesion between the dowel shank and the concrete results in the force of the vertical tension component 6A being transferred until it reaches the dowel head or dowel strip, respectively.

The sloped main tensile stress 10 forming in the concrete leads to the formation of shearing cracks 12 in the concrete extending approximately along the sloped strut components 10, whereby the width of the cracks restricts the load carrying capacity of the beam or panel.

According to a known reinforcement technique, the width of unavoidable shearing cracks in the concrete is limited and the carrying capacity of the structural beam increased by inserting additional bent-up bars essentially extending perpendicular to the expected direction of the cracks.

In a beam or panel equipped with dowel strips serving as bent-up bars, according to this prior art theory, either the bent-up bars consisting of dowel strips would be reinforced by using more or larger diameter dowels, or a separate, additional bent-up bar would be inserted to limit the width of the cracks. Both measures, however, involve additional material and labor costs.

In a known dowel strip of the above kind (EP-A-495 334), the dowels are made from ribbed reinforcement bar; the dowel shank has ribs on its surface. The vertical tension member force acting inside the dowel shank is thus not at all or only to an insignificant extent transmitted to the end of the dowel, with the result that the desired formation of a truss framework joint at the dowel ends is impaired.

The aim of the invention is therefore to design a dowel strip configuration to effectively limit the width of the cracks in the concrete without additional material or labor expenditures while maintaining the effective formation of truss framework joints at the dowel heads.

SUMMARY OF THE INVENTION

This aim is attained according to the invention by a dowel shank having a smooth, cylindrical shape at its two shank end sections and a shank center section with a ribbed surface located in between.

The transmission of the force of the vertical tension component required for the formation of a truss framework joint at the two ends of each dowel is acheived by the two shank end sections adjacent to the dowel ends being smooth and therefore effecting only a very minor adhesion with the surrounding concrete. The shank center section, which preferably consists of a ribbed reinforcement bar, effects the desired good adhesion between the dowel and the surrounding concrete with its ribbed surface located between the two smooth shank end sections. This adhesion limits the width of the shearing cracks forming along the sloped struts. The result is an increased load carrying capacity of the beam or panel reinforced in this fashion without the need for any additional reinforcement.

The dowel shank may be manufactured from a ribbed reinforcement bar, the ribs of which are smoothed-away at the two shank end sections. It is also possible instead, to have a shank center section made of a ribbed reinforcement bar welded to two shank end sections made of smooth rod-steel.

The length of the ribbed shank center section essentially depends on the height in which the shearing cracks that need to be limited are expected to occur in the concrete. This may be determined in the individual situation from the location of the forming sloped struts that may be determined according to the above truss model for each individual application.

BRIEF DESCRIPTION OF THE DRAWINGS

An example design of the invention shown in the drawing is explained in more detail below. The drawings show the figures as follows:

FIG. 1 a simplified partial longitudinal section through a beam at the point of support of a column, using a dowel strip according to the present invention, FIG. 2 a sectional view along line 2—2 of FIG. 1, FIG. 3 an enlarged partial view and a section of one of the dowel strips serving as bent-up bars in the example according to FIGS. 1 and 2;

FIG. 4 is a view similar to FIG. 1 using a prior art dowel strip; and

FIG. 5 is a fragmentary view of a modified form of dowel strip according to the invention.

DETAILED DESCRIPTION OF A PREFERRED EMBODIMENT OF THE INVENTION

Figure 3:
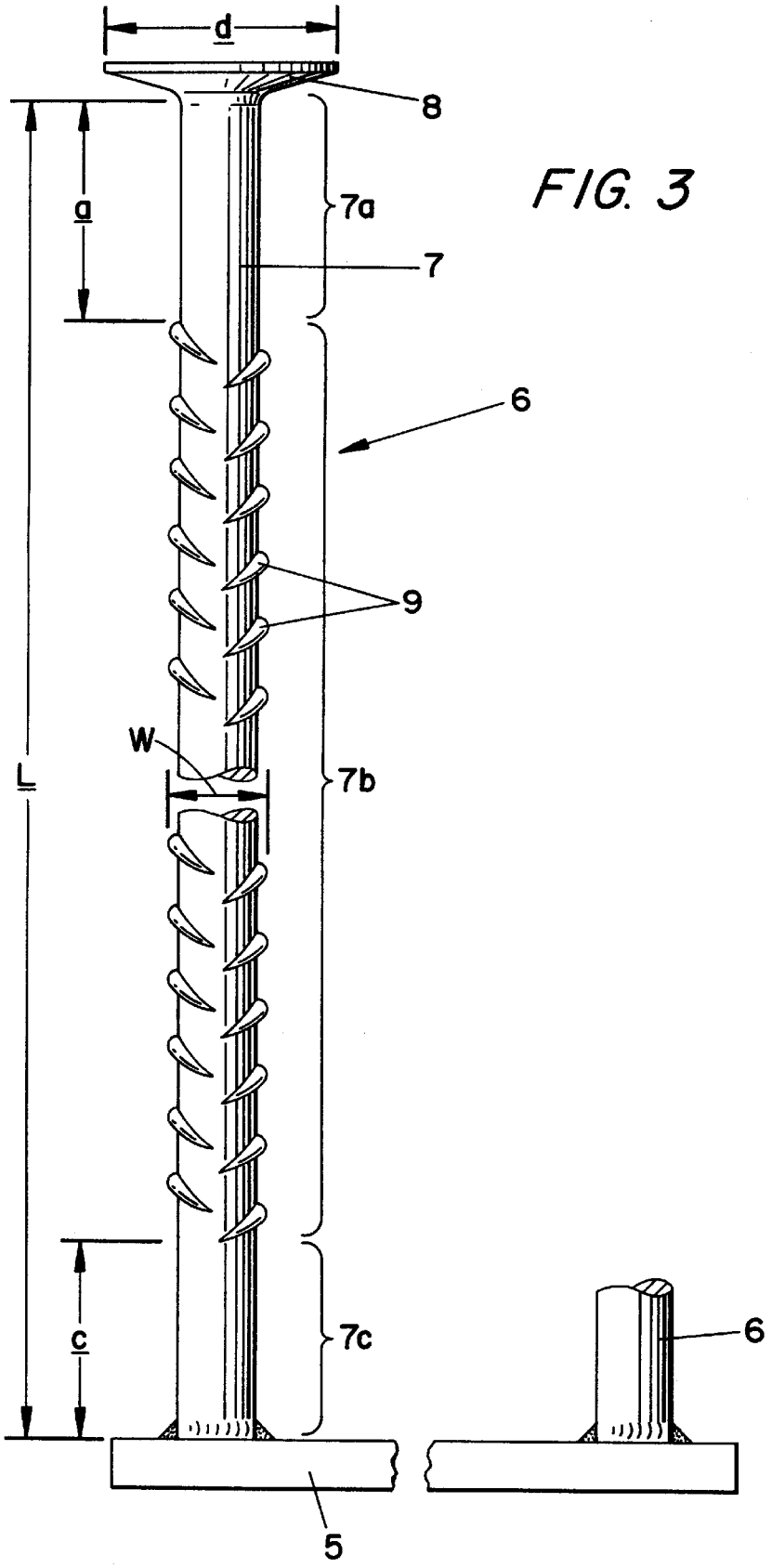

The reinforced concrete beam 1 shown in FIG. 1 is supported by a column 2. Horizontal ribbed reinforcement bars 3 have been inserted on the topside of the beam 1 to act as the tension cord component of the earlier described internal force truss.

Several dowel strips 4 have been inserted to act as bent-up bars in beam 1 in the vicinity of column 2. In the depicted example design, these consist of a bottom strip 5 extending in a direction perpendicular to the longitudinal direction of the beam and a vertical dowel 6 attached at each end of the strip 5, the dowels 6 extending perpendicular to the strip.

As shown in a detailed view in FIG. 3, each dowel 6 has a dowel shank 7 whose lower end is welded onto the strip 5. At its upper end the dowel shank 7 is connected to a widened, plate-shaped dowel head 8 preferably designed with a flat, truncated shape on its side facing the dowel shank 7.

At its two shank end sections 7*a* and 7*b*, facing the dowel head 8 and the strip 5, respectively, the dowel shank 7 has a smooth, cylindrical shape. A shank center section 7*b* located between the end sections 7*a*, 7*b* ribbed reinforcement bar having ribs 9 on its surface.

The length a or c of one or both shank end sections 7*a* or 7*b* corresponds, for example, to 1 to 2 times the diameter d of the dowel head 8. In the shown example, the length a or c of one or both shank end sections 7*a* or 7*b* also corresponds to ¼ to 1/10 of the length L of the dowel shank 7.

In the shown example the dowel shank 7 is a ribbed reinforcement bar, the ribs 9 of which are smoothed (i.e., ground-down) on the two shank end sections 7*a* and 7*c*. It is also possible instead, to manufacture only the shank center section 7*b* as a ribbed reinforcement bar and weld it to two shank end sections 7*a* and 7*c* made of smooth rod-steel. In either case the ribs 9 project from an outer surface of the center section and are thus fixed to that surface. The ribs define a maximum width W of the center section, and that width W is shorter than the width d of the dowel head 8.

In a deviation from the shown example design, the shank end sections could be larger in diameter than the shank center section 7*b*as shown in FIG. 5 in connection with one of the end sections 7*c'*.

As shown in a simplified form in FIG. 1, the earlier described regions of compression 10 form inside beam 1 due to the force transmitted by column 2, whereby these regions, hereinafter called "internal struts" 10, extend diagonally upwards to the dowel heads 8 of the dowel strips 4.

Other regions of compression 11, which extend horizontally and are each hereinafter called a "compression chord" 11 are formed in the concrete at the underside of the beam 1.

The upper tension chord component 3, the bottom compression chord component 11, the sloped internal struts 10, and the dowels 6 acting as vertical tension components apply a lattice-like pattern of forces, hereinafter called a force truss inside beam 1. The sloped internal internal struts 10 extend from the dowel heads 8 not only to the point of support of column 2, but partially also to the strips 5 at the lower ends of the dowels 6.

This results in the formation of force truss joints at the dowel heads 8 and the strips 5. Since the shank end sections 7*a* and 7*c* of the dowels 6 do not provide any significant adhesion with the surrounding concrete because of their smooth exterior, the introduction of the beam force at the dowel ends takes place almost exclusively through the positive splice of the dowel heads 8 or the strips 5, respectively.

Shearing cracks 12 form in the concrete along the internal struts 10, as indicated in FIG. 1. It is apparent that these shearing cracks 12 cross the dowels 6 of the dowel strips 4 mainly in the vicinity of the shank center sections 7*b*. In this area the ribs 9 create a good adhesion between the dowel shank 7 and the surrounding concrete. This adhesion between the concrete and the reinforcement counteracts a widening of the shearing cracks 12 and thus effectively limits the width of the cracks.

We claim:

1. A dowel member for reinforcing concrete structures, comprising:

a metal strip; and a plurality of dowels attached in spaced apart relationship to said strip, each dowel including:

a metal dowel shank extending perpendicular to said strip and including a first end section, a second end section, and a center section disposed between said first and second end sections, each of said first and second end sections having a smooth cylindrical outer periphery, said center section including an outer surface and ribs projecting outwardly from said outer surface, each rib being fixed to said outer surface for transferring forces directly to said dowel, said first end section being welded to said strip, and a dowel head disposed on said second end, the dowel head being wider than said dowel shank.

2. The dowel member according to claim 1, wherein the metal dowel shank is formed from a ribbed reinforcement bar, the ends of which are ground smooth to define said end sections.

3. The dowel member according to claim 1, wherein said metal dowel shank comprises a ribbed reinforcement bar defining said center section, and a pair of bar pieces welded onto respective ends of said ribbed reinforcement bar to define said end sections.

4. The dowel member according to claim 1, wherein a length of at least one of said end sections is equal to about 1 to 2 times a diameter of said dowel head.

5. The dowel member according to claim 1, wherein a length of at least one of said end sections is equal to about 1/10 to ¼ of a length of said dowel shank.

6. The dowel member according to claim 1, wherein each of said end sections is larger in diameter than said center section.

7. The dowel member according to claim 1 wherein the ribs define a maximum width of the center section, said dowel head being wider than said maximum width.

* * * * *